US010781617B2

(12) United States Patent
Pudney et al.

(10) Patent No.: US 10,781,617 B2
(45) Date of Patent: Sep. 22, 2020

(54) VEHICULAR DOOR HANDLE ASSEMBLY AND METHOD FOR ASSEMBLING THE SAME

(71) Applicant: Novares US LLC, Livonia, MI (US)

(72) Inventors: Richard Pudney, Plymouth, MI (US); David Brent Egnor, Ypsilanti, MI (US); Timothy Bugenski, Sterling Heights, MI (US)

(73) Assignee: Novares US LLC, Livonia, MI (US)

( * ) Notice: Subject to any disclaimer, the term of this patent is extended or adjusted under 35 U.S.C. 154(b) by 270 days.

(21) Appl. No.: 15/674,295

(22) Filed: Aug. 10, 2017

(65) Prior Publication Data

US 2019/0048627 A1 Feb. 14, 2019

(51) Int. Cl.
*E05B 85/16* (2014.01)
*E05B 79/06* (2014.01)
(Continued)

(52) U.S. Cl.
CPC ..... *E05B 85/16* (2013.01); *E05B 79/06* (2013.01); *E05B 79/22* (2013.01); *E05B 83/36* (2013.01);
(Continued)

(58) Field of Classification Search
CPC ..... E05B 85/16; E05B 79/00; E05B 79/06; E05B 79/22; E05B 83/36; E05B 77/02;
(Continued)

(56) References Cited

U.S. PATENT DOCUMENTS 6,363,577 B1 * 4/2002 Spitzley ..... E05B 79/06 16/438
7,971,913 B2 * 7/2011 Sunahara ..... E05B 85/16 292/336.3

(Continued)

FOREIGN PATENT DOCUMENTS

DE 10 2015 104870 A1 10/2016
WO WO 2013/109306 A2 7/2013
WO WO 2018/153531 A1 8/2018

OTHER PUBLICATIONS

Notification of Transmittal of the International Search Report and Written Opinion of the International Searching Authority (PCT/ISA/220/210/237) dated Oct. 24, 2018 (16 pages).

*Primary Examiner* — Nathan Cumar
(74) *Attorney, Agent, or Firm* — Gunther J. Evanina; Butzel Long

(57) ABSTRACT

A vehicular door handle assembly for opening a vehicle door is provided and includes a door grip having a forward end and a rearward end, the door grip movable from a resting position where the vehicle door is latched to an actuated position where the vehicle door is unlatched. The assembly further includes a chassis assembly having a forward end and a rearward end. A rear end of the chassis assembly supports a bellcrank rotatably connected to the chassis and connected to the door grip. The bellcrank pivots between a resting position and an actuated position when the door handle is actuated. Further still, the assembly includes a moveable retaining element to retain the bellcrank in a serviceable position where the door grip can be connected to the bellcrank and to release the bellcrank to a functional position where the bellcrank rotates between the resting position and the actuated position.

9 Claims, 8 Drawing Sheets

(51) Int. Cl.
*E05B 79/22* (2014.01)
*E05B 83/36* (2014.01)
*E05B 77/02* (2014.01)

(52) U.S. Cl.
CPC ..... *E05B 77/02* (2013.01); *E05Y 2900/531* (2013.01)

(58) Field of Classification Search
CPC ..... E05B 77/04; E05B 85/14; E05B 79/02; E05B 77/06; E05B 77/00; E05Y 2900/531; E05Y 2900/532
USPC ..... 292/336.3
See application file for complete search history.

(56) References Cited

U.S. PATENT DOCUMENTS

| | | | | |
|---|---|---|---|---|
| 8,757,686 | B2 * | 6/2014 | Ishida | E05B 85/14 292/336.3 |
| 8,894,108 | B2 * | 11/2014 | Corwin | E05B 77/06 292/336.3 |
| 9,644,394 | B2 * | 5/2017 | Breimayer | E05B 79/06 |
| 2007/0069533 | A1 * | 3/2007 | Cummins | E05B 47/004 292/336.3 |

* cited by examiner

VEHICULAR DOOR HANDLE ASSEMBLY AND METHOD FOR ASSEMBLING THE SAME

FIELD

The present disclosure relates generally to vehicular door handle assemblies.

BACKGROUND

The statements in this section merely provide background information related to the present disclosure and may not constitute prior art.

Vehicular door handle assemblies typically comprise two sub-components, i.e. a door grip assembly and a chassis assembly. The chassis assembly is secured onto the internal side of a metal sheet which forms the vehicular door and the door grip assembly is connected to the chassis assembly through a first forward passageway and a second rearward passageway provided in the vehicular door. While the chassis assembly is positioned on the internal side of the door panel, the handle assembly is positioned on the external side of the door panel; the assembling operations of door handle thus require to secure an external door grip on an internal chassis assembly, bearing in mind that, once assembled, the door grip is configured to be movable in a position where the door handle releases an appropriate door latching mechanism. To this end, the door grip is usually linked with a bellcrank which in turn is suitably connected to the door latching mechanism.

Prior art door handle assemblies prove not to be entirely satisfactory as they, and especially their chassis assembly sub-component, tend to be complex and expensive to make.

SUMMARY

The present disclosure provides a vehicular door handle assembly for opening a vehicle door comprising:

a door grip having a forward end and a rearward end, movable from a resting position where the vehicle door is latched to an actuated position where the vehicle door is unlatched;

a chassis assembly having a forward end and a rearward end, the chassis assembly supporting, at its rearward end;

a bell crank rotatably connected to the chassis and connected to the door grip, configured to pivot between a resting position and an actuated position when the door handle is actuated; and a moveable retaining element configured to retain the bellcrank in a serviceable position where the door grip can be connected to the bellcrank and to release the bellcrank to a functional position where the bellcrank can rotate between the resting position and the actuated position.

In one form, the bellcrank rotates with regards to the chassis within an angular stroke defined by:

a serviceable position wherein the retaining element maintains the bellcrank in a position where the door grip is connectable or disconnectable from the bell crank;

a resting position wherein the bellcrank maintains the door grip against the vehicle door; and an actuated position wherein the retaining element maintains the bell crank in a position wherein the bell crank actuates a latch mechanism and wherein the bellcrank remains engaged with the door grip.

In one form, the present disclosure provides a driving feature operable from the chassis rearward end configured to move the retaining element relative to the chassis assembly from the serviceable position to the resting position.

In one variation, the retaining element comprises a sliding element having a sliding part and at least one arm configured to cooperate with the bellcrank.

In an another variation, the at least one arm includes a hook and the bellcrank includes a shoulder where the hook seats.

In still another variation, the sliding element includes at least one rotation stop where the bellcrank abuts in the actuated position, wherein the bell crank actuates a latch mechanism and wherein the bellcrank remains engaged with the door grip.

In yet another variation, the chassis includes a central opening and the bellcrank includes a locking clip, which is substantially flush with the central opening in a serviceable position.

In a further variation, the bellcrank angular stroke is defined by the hook provided at the end of the at least one arm and by at least one rotation stop provided at the sliding member front end.

The present disclosure further provides a method of installing a vehicle door assembly on a vehicular door panel having an external side and an internal side and at least a front passageway and a second passageway, the method comprising the steps of:

providing a chassis assembly having a forward end and a rearward end, said forward end having connecting features and said second end having a rotatable bellcrank maintained in a serviceable position by a retaining element;

securing the chassis assembly on the internal side of the door panel;

providing a door grip movable to an actuated position to open a vehicle door, having a forward end and a rearward end, said forward end having a connection feature to connect with chassis front end connecting features, said rearward end having a plunger;

mounting the handle grip on the chassis forward end;

connecting the plunger on the bellcrank; and moving the retaining element to a position where the bellcrank can rotate between a resting position and an actuated position.

Further areas of applicability will become apparent from the description provided herein. It should be understood that the description and specific examples are intended for purposes of illustration only and are not intended to limit the scope of the present disclosure.

DRAWINGS

In order that the disclosure may be well understood, there will now be described various forms thereof, given by way of example, reference being made to the accompanying drawings, in which.

Figure 1:
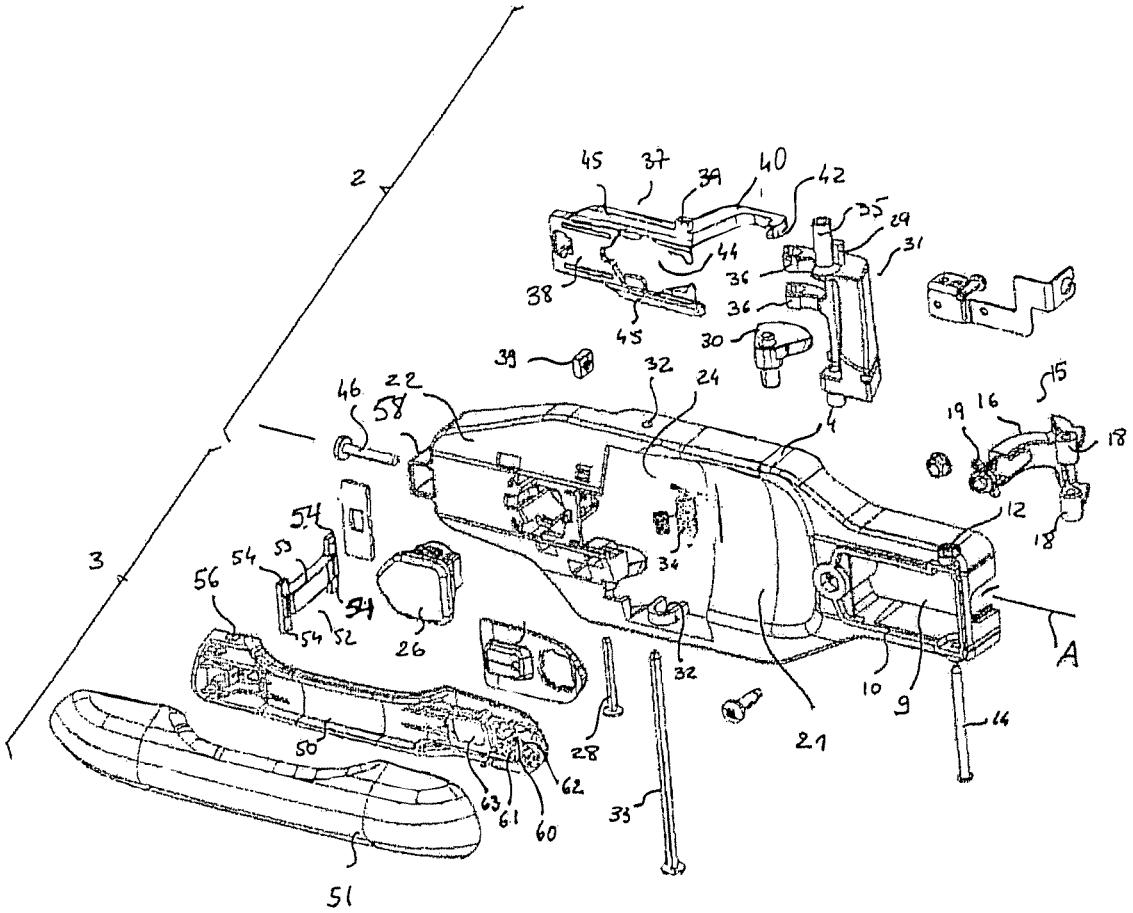
FIG. 1 is an exploded perspective view of a door handle assembly according to one form of the present disclosure.

The drawings described herein are for illustration purposes only and are not intended to limit the scope of the present disclosure in any way.

DETAILED DESCRIPTION

The following description is merely exemplary in nature and is not intended to limit the present disclosure, application, or uses. It should be understood that throughout the drawings, corresponding reference numerals indicate like or corresponding parts and features.

The present disclosure provides a door handle assembly and a method for installing the door handle assembly on a vehicle door.

It should be understood that the door handle assembly as described herein is characterized with respect to a forward, rearward, upper, and lower orientation, wherein forward is toward a front end of the vehicle, rearward is toward a rear end of the vehicle, external is away from the center of the vehicle and internal is closer to the center of the vehicle. This orientation is for exemplary purposes only and is not meant to limit the present disclosure in any manner. It will be apparent to one of ordinary skill in the vehicular handle art that the door handle assembly can be positioned on a vehicular door in any suitable fashion.

Referring now to FIGS. 1 to 15, the present disclosure is described in relation to exemplary forms thereof.

As shown, the vehicular door handle assembly of the present disclosure includes two subcomponents namely a chassis 2 and a door grip 3.

The chassis 2 can be a plastic component which can be made by injection molding but other suitable materials are contemplated. The chassis 2 has an external face which is intended to face the internal face of an exterior vehicle door panel which can be made of metal or of any other suitable material and has an internal face opposite the external face.

Figure 3:
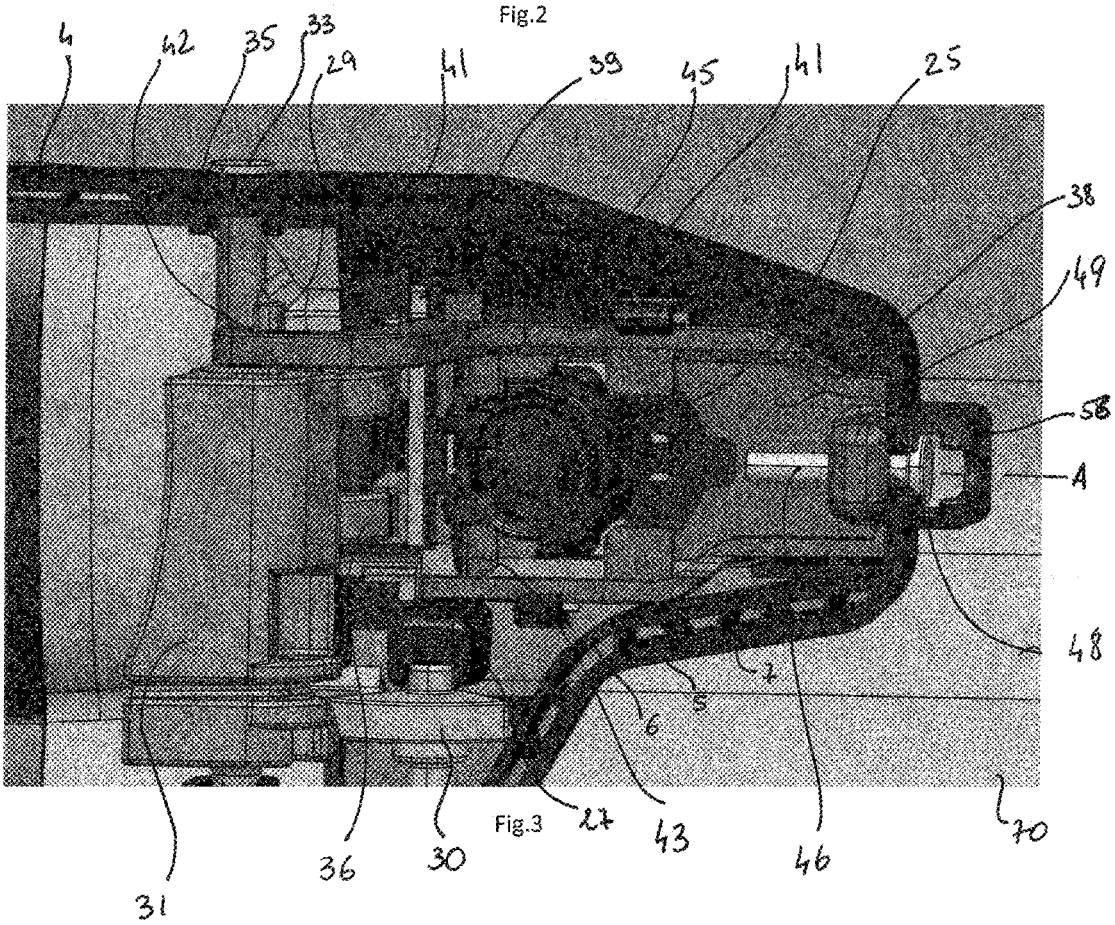
FIGS. 3 and 4 illustrate an internal view of two forms of a chassis assembly of FIG. 1.

As can be seen in FIG. 3, the chassis 2 includes a peripheral ridge 4 which makes provision for the chassis rigidity.

In the illustrated form of the present disclosure, the peripheral ridge 4 is comprised of two walls 5 and 6 linked by a series of ribs 7.

In the illustrated variation of the present disclosure, the chassis 2 has an elongated shape and has a longitudinal axis A.

At its forward end, the chassis 2 is provided with a first opening 9. The first opening 9 has a generally rectangular shape. The first opening 9 can be equipped with a rib structure 10 that contacts the internal face of a door panel when the chassis 2 is assembled to a door structure. Two holes 12 are provided in the wall which surrounds the front opening 9; a pivot pin 14 is inserted in the holes 12.

In the illustrated form of the present disclosure, a rotatable arm 15 is mounted within the front opening 9 of the chassis 2. To this end, the arm 15 has a central curved section 16 and a fork having two plain bearings 18 wherein the pivot pin 14 is inserted. The arm 15 is thus sturdily connected to the chassis 2, as the pivot linkage which connects the arm 15 to the chassis 2 can extend over a significant transversal dimension. At its free end, the arm 15 can include a series of radial lugs 19.

Next to the first opening 9, the chassis 2 includes a central wall 21 that extends transversally within the peripheral ridge 4.

At its second end, the chassis 2 includes a support section 22 which extends within the peripheral ridge 4 at the rearward end of the chassis 2.

As it can be seen on the FIGS. 1, 6, 7 and 10, the transversal wall 21 and the support section 22 are spaced apart. In other words, the chassis 2 is provided with a central opening 24 which is defined between the transversal wall 21 and the support section 22.

Figure 4:
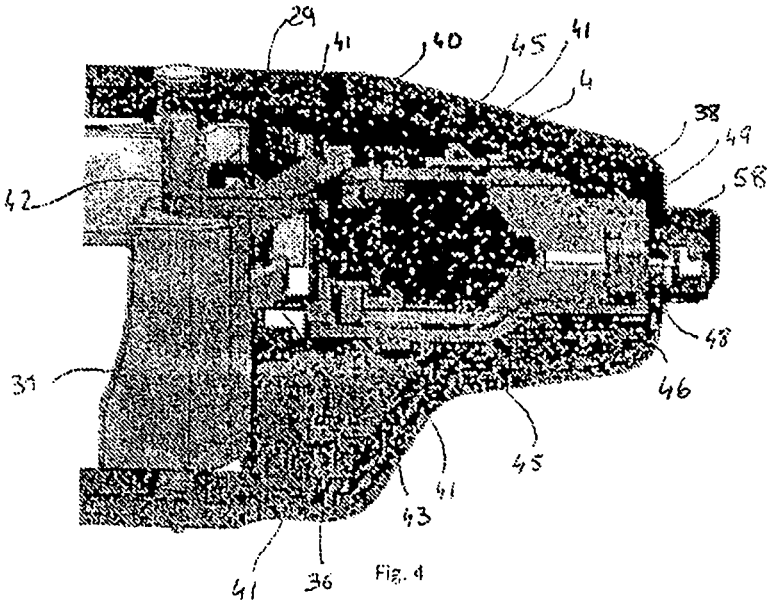

In the illustrated example of the present disclosure of FIGS. 1 and 3, the support section 22 can optionally be provided with a funnel 25 which extends from the internal face of the chassis 2. The funnel 25 is configured to accommodate a plug 26. The plug 26 can include a locking cylinder or any suitable mechanism for locking and unlocking the vehicle door with a key. FIG. 4 shows one form where the support section is devoid of a funnel and thus cannot receive a plug.

The internal face of the chassis 2 is also equipped with a lug 27 provided with a hole suitable to receive a pivot pin 28. An inertia lock 30 is mounted on the pivot pin 28 and is configured to inhibit the vehicle door from opening in the case of a deceleration force caused by an impact with the vehicle.

In one form, a bellcrank 31 is also rotatably mounted on the chassis 2. To this end, the chassis 2 is provided with two holes 32 which are formed in the peripheral ridge 4. A pivot pin 33 is inserted in the holes 32; the bellcrank 31 which includes a plain bearing 35 is engaged on the pivot pin 33 and thus the bellcrank 31 can rotate about the pivot pin 33. The bellcrank 31 is biased by a torsion coil spring 34 toward a resting position that is to say a position where the door is latched by suitable means onto the vehicle body. As can be seen in FIG. 3, for example, the bellcrank 31 includes a shoulder 29; in the illustrated form, the shoulder 29 protrudes from the bearing 35.

The bellcrank 31 is also equipped with a fork which has two locking clips 36, each locking clip 36 includes two curved arms. The central opening 24 is sized and shaped to accommodate the bellcrank 31 and to allow rotation of the bellcrank 31 between a resting position of the bellcrank 31 wherein a vehicle door locked position and an actuated position of the bellcrank 31 wherein a vehicle door actuated position. To this end, the vehicle door is suitably equipped with appropriate features (not illustrated) to latch and actuate the vehicle door upon an action by a user on the handle grip.

The chassis 2 further includes a sliding member 37. The sliding member 37 can move between a first rearward position and a second frontward position. The sliding member 37 can thus occupy (i) a first serviceable position where the sliding member 37 maintains the bellcrank 31 against the spring 34 in position where the locking clips 36 are substantially flush with the central opening and (ii) a second functional position where the sliding member 37 releases the rotation of the bellcrank 31; in the said second position of the sliding member 37, the bellcrank 31 can rotate between its resting position and its actuated position.

As it will become apparent later, the serviceable position is a transitional position conveniently used during shipping, assembling and servicing of the chassis assembly. When assembled, the door handle assembly can be in a resting position wherein the door grip 3 is maintained against a door panel 70 and an actuated position wherein the door grip 3 is pulled by a user to open the vehicle door.

The sliding member 37 is provided with a sliding part 38 and an arm 40. As can be seen in the Figures, the sliding part 38 has a general U-shape and includes an opening 44. The opening 44 is defined between two longitudinal beams 45. The sliding part 38 is suitably equipped with guiding tabs 39 which make it possible to guide the sliding member 37 in its move with regards to the chassis 2. For this purpose, the chassis 2 is also equipped with a series of guiding lugs 41 where the guiding tabs 39 and the sliding part side edges are guided. The sliding member 37 is also provided with two rotation stops 43 which are located at the end of each longitudinal beam 44. The arm 40 has a C-shape or goose-neck shape which goes around the bellcrank 31 and the end of which is fitted with a hook 42.

In the illustrated form, the sliding member 37 is slidingly moveable relative to the chassis by a screw 46. The sliding member 37 is provided with a tower structure 49 wherein a square nut 39 is secured by press fit. The screw 46 is engaged in the nut 39 while the screw head remains within a cage 58.

Figure 6:
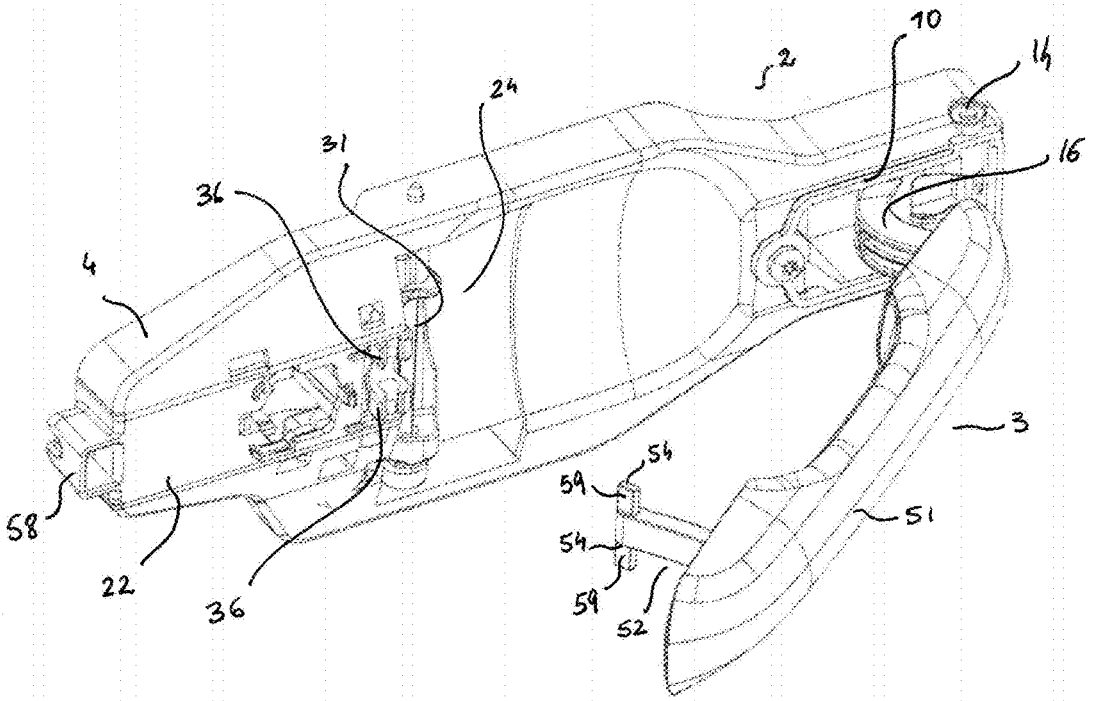
FIGS. 6 and 7 illustrate in perspective a chassis assembly and a door grip assembly according to the present disclosure.

FIGS. 3 and 4 show the chassis 2 in a so called serviceable position where the sliding member 37 is in its extreme rearward position. In the said serviceable position, the hook 42 is in contact with the bellcrank shoulder 29 and maintains the bellcrank 31 against the spring 34. The sliding member 37 maintains the bellcrank 31 in the serviceable position where the locking clips 36 protrude from the central opening 24. FIG. 6, for example, shows the chassis in its serviceable position with the locking clips 36 slightly protruding from the central opening 24.

Figure 2:
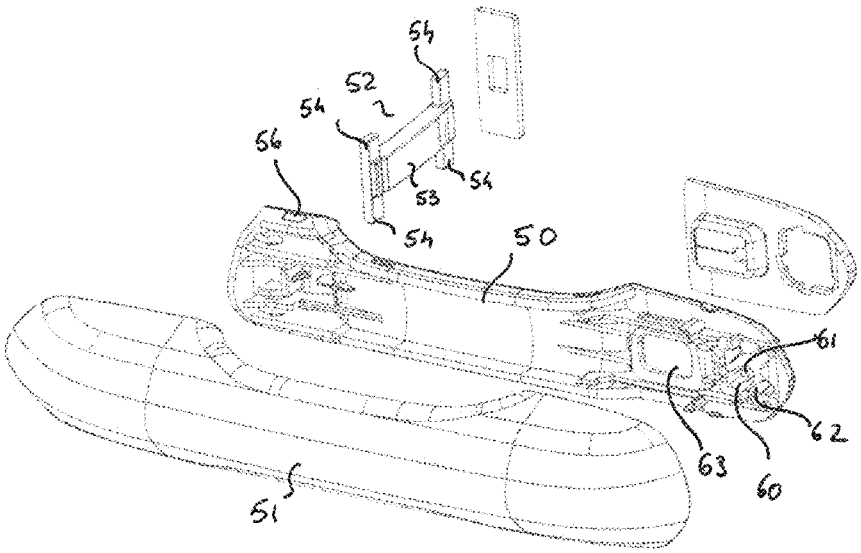
FIG. 2 is an exploded perspective view of a door grip of the door handle assembly of FIG. 1.

Referring now to FIG. 2, in one exemplary form, the door grip 3 can comprise a frame 50 which supports a handle shell 51. The frame 50 supports at its rearward end a rotatable plunger 52 and is further provided, at its forward end, with a connecting feature configured to engage the rotatable arm 15 in a rigid manner.

The frame 50 has a general elongated and arcuate shape which makes it possible to accommodate a user's hand.

The handle shell 51 is positioned over the frame 50 and is suitably secured thereto by a series of tabs or similar suitable connectors which secure the hand shell 51 on the frame 50.

Figure 8:
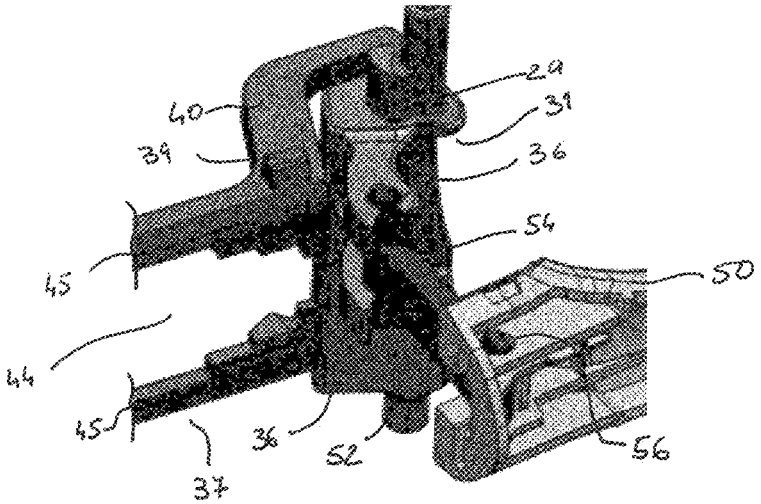
FIGS. 8 and 9 illustrate a door handle assembly rearward pivot linkage where the door panel and other components have been removed according to the present disclosure.

Referring, for example, to FIGS. 2 and 6, the plunger 52 can include a central part 53 and four pins 54 positioned at both ends of the central part. Thus, the plunger 52 is connected to the frame 50 via a pivot linkage. The frame 50 is suitably provided with two holes 56 where two pins 54 of the plunger 52 can seat and rotate. FIG. 8 shows the engagement of plunger pins 54 in the holes 56 provided in the frame 50 and the plunger 52 rotation authorized by the pivot linkage between the plunger 52 and the frame 50.

At its forward end, the frame 50 includes means for connection with the rotatable arm 15. In the illustrated example, the frame 50 includes an opening 60 which has a series of radial grooves 61 alternating with a series of radial retaining lips 62 which are sized and spaced to accommodate the radial tabs 19. The radial grooves 61 and retaining lips 62 are spaced and oriented in manner such that when the frame 50 is placed in a position parallel to the frame A axis, the radial tabs 19 are locked by the retaining lips 62.

Adjacent to the means for connection with the rotatable arm 15, the frame 50 can include a passageway 63. This passageway 63 can be optionally used for wires connecting an electronic module located in the door handle.

Figure 14:
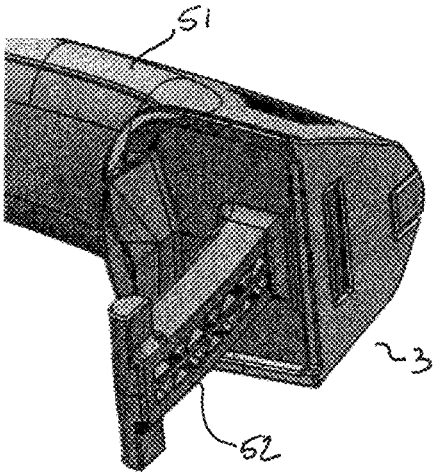
FIGS. 14 and 15 illustrate alternative forms of a door grip according to the present disclosure.
Figure 15:
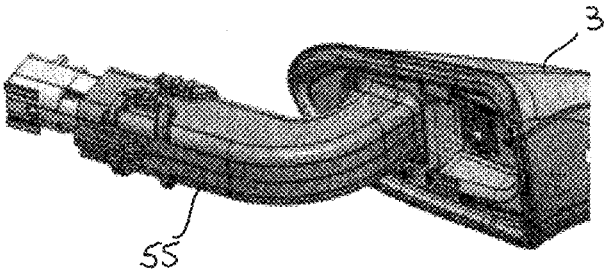

In other forms illustrated in FIGS. 14 and 15, the door grip 3 can include a plunger 52 rigidly attached to the frame 50 and/or can include a forward pivot arm 55 attached to the frame 50 bearing in mind that, in such case, the chassis is provided with suitable connecting features.

The operation of assembling the door handle assembly 1 of the present disclosure includes a first stage where the chassis 2 is secured on the internal face of the metal sheet which forms the vehicle door, by any suitable attachment means such as a rivet or screw, among others.

Figure 5:
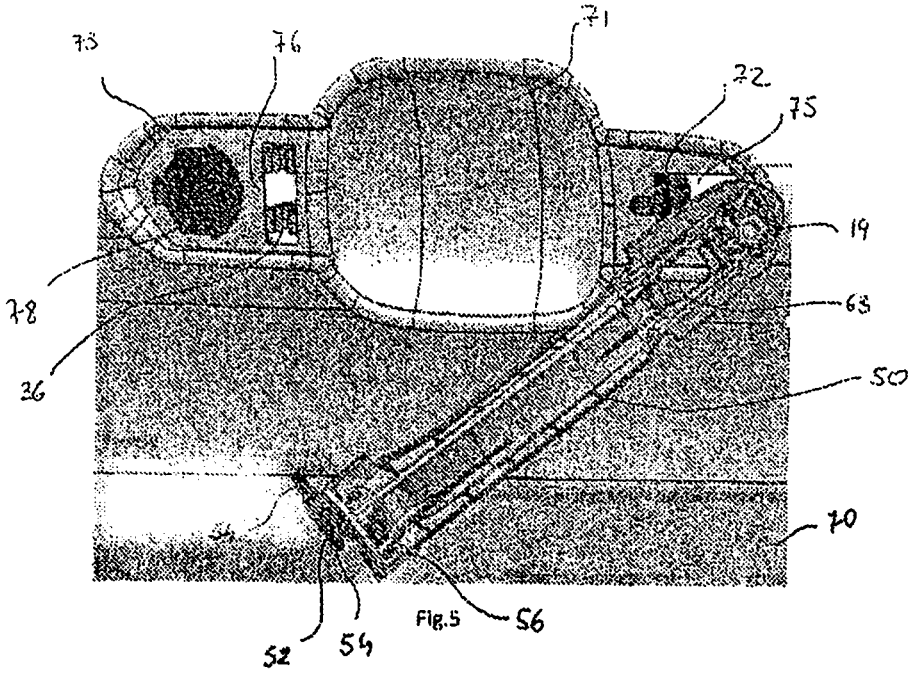
FIG. 5 illustrates an external view of a chassis secured on a door panel according to the present disclosure.

The door panel 70 which can be seen on FIG. 5 is provided with an embossed area comprised of a central curved part 71 configured to accommodate the hand of a user, of a forward embossed section 72 and of a rearward embossed section 73. In the illustrated form, the forward embossed section 72 is provided with a passageway 75 which has a substantially rectangular shape and the rearward embossed section 73 is provided with a passageway 76 proximate to the central curved part which has a rectangular slot shape and a distal passageway 78 which has a substantially round shape.

During this assembling stage, the chassis 2 is secured in the internal side of the door panel 70.

The chassis 2 is its serviceable position that is to say in a position wherein the sliding member 37 maintains the bellcrank 31 as the hook 42 is in contact with the bellcrank shoulder 29 and maintains the bellcrank 31 against the spring 34.

Figure 9:
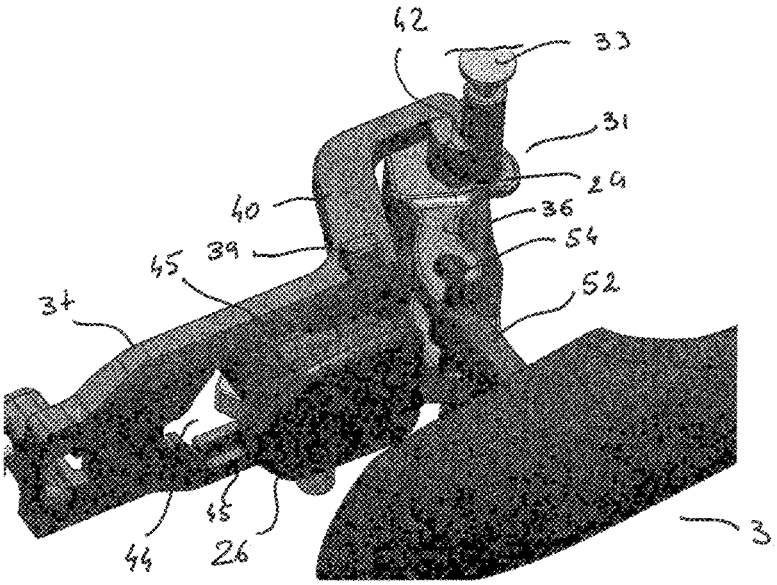
Figure 10:
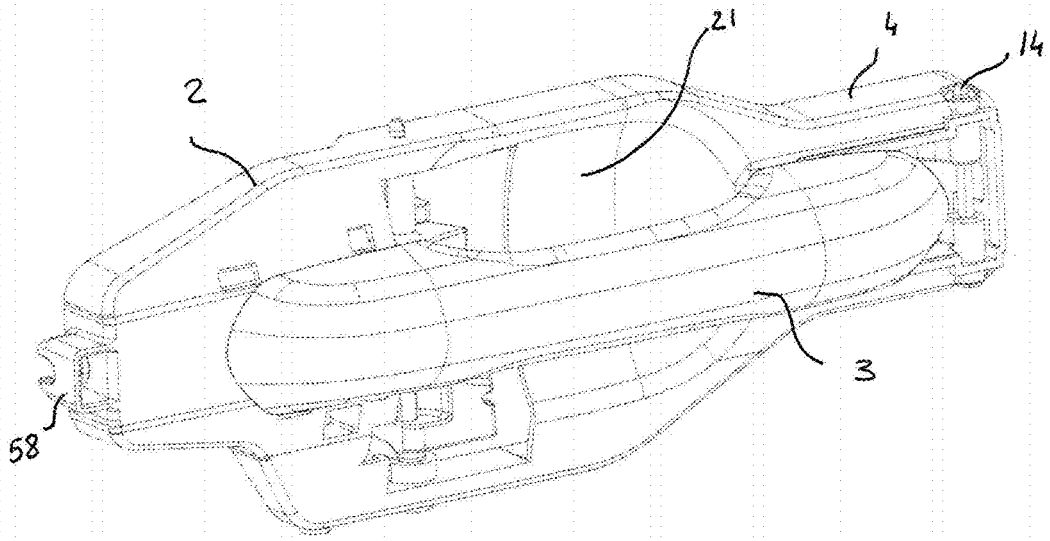
FIG. 10 illustrates an external view of a door handle assembly in a resting position according to the present disclosure.

In a second stage shown in FIGS. 8 to 10, the forward end of the door grip 3 is attached to the forward end of the chassis 2.

In the form illustrated of FIGS. 1 to 7, the door grip 3 is connected to the free end of the arm 15. To this end, the arm 15 is fully rotated and protrudes above the surface of the metal sheet.

The door grip 3 is approached to the door panel embossed area and the attachment part of the chassis 2 is engaged on the arm free end. More precisely, in the illustrated form, the arm radial lugs 19 engage into the corresponding radial grooves 62. By rotating the door grip 3 towards a position where the door grip is substantially superimposed with the chassis 2 longitudinal axis A, the radial lugs 19 eventually are superimposed on the retaining lips 62. The attachment part can also suitably include a ramp to form a locking wedge.

Figure 7:
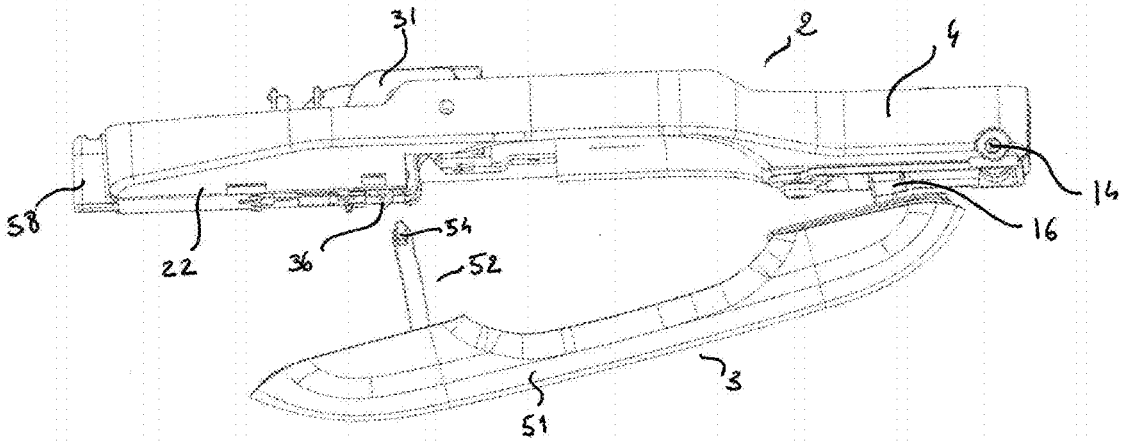

Then, the door grip 3 rotates about the forward pivot linkage and connects the plunger 52 with the bellcrank 31. To achieve this, the door grip 3 is rotated towards the embossed area, thereby bringing the plunger 52 into engagement with the bellcrank 31 as shown in FIGS. 7 to 9. By pushing the door grip 3, the pins 54 provided at the end of the plunger 52 engage into the bellcrank 31 locking clips, thereby creating a rearward linkage of the door handle and the chassis 2.

In the case of a door grip 3 as shown on FIG. 15, the forward pivot arm 55 is connected to suitable features provided in the chassis 2 forward end.

The next stage makes provision for the rear end linkage. The free end of the plunger 52 engages the locking clips 36. As shown on FIG. 6, the plunger pins 54 can be provided with a flat portion 59 which allows introduction of the plunger pins 54 in the locking clips 36.

FIGS. 8 and 9 show the plungers pins 54 engaged in the locking clips 36.

To secure the rearward linkage between the door grip 3 with the chassis 2, that is to say the linkage between the plunger 52 and the bellcrank 31, the sliding member 37 is moved toward a forward position by rotation of the screw 46.

By moving forward, the sliding member 37 releases the bellcrank 31 which in turn rotates about the pivot pin 33 and thus locks the plunger pins 54 in the locking clip 36. In its forward position, the sliding member 37 is locked by the engagement of the guiding tabs 39 of the sliding member 37 in the guiding lugs 41 provided in the chassis 2.

It can be noted that simultaneously, the sliding member 37 locks the plug 26, should the door handle assembly include a plug 26.

Figure 11:
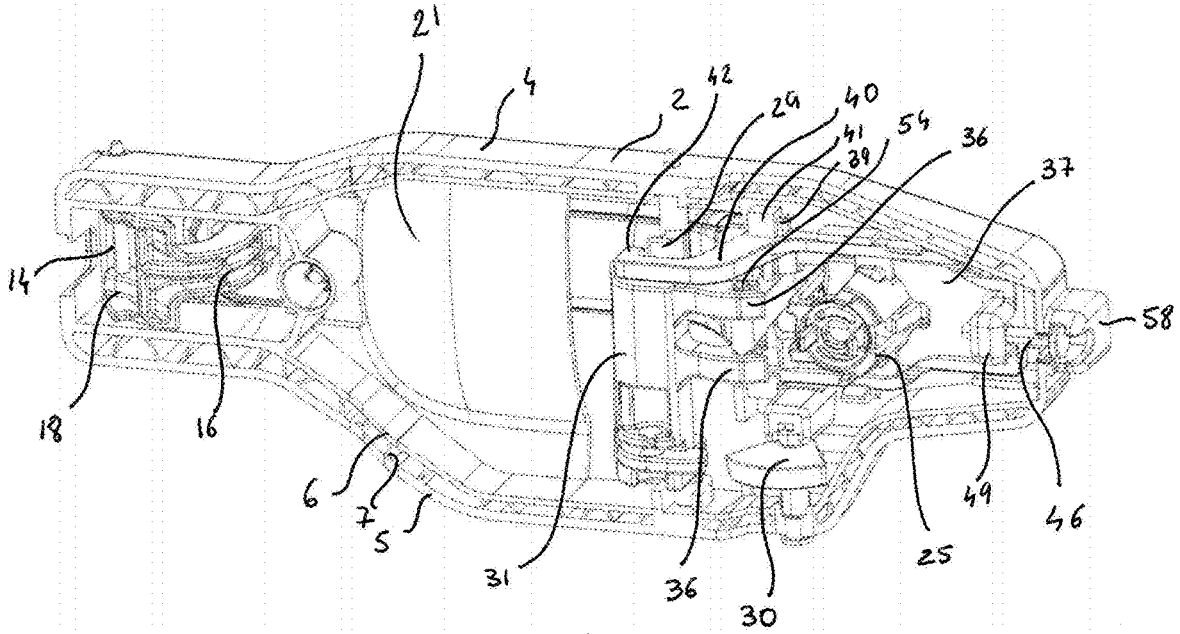
FIG. 11 illustrates an internal view of a door handle assembly in a resting position according to the present disclosure.
Figure 12:
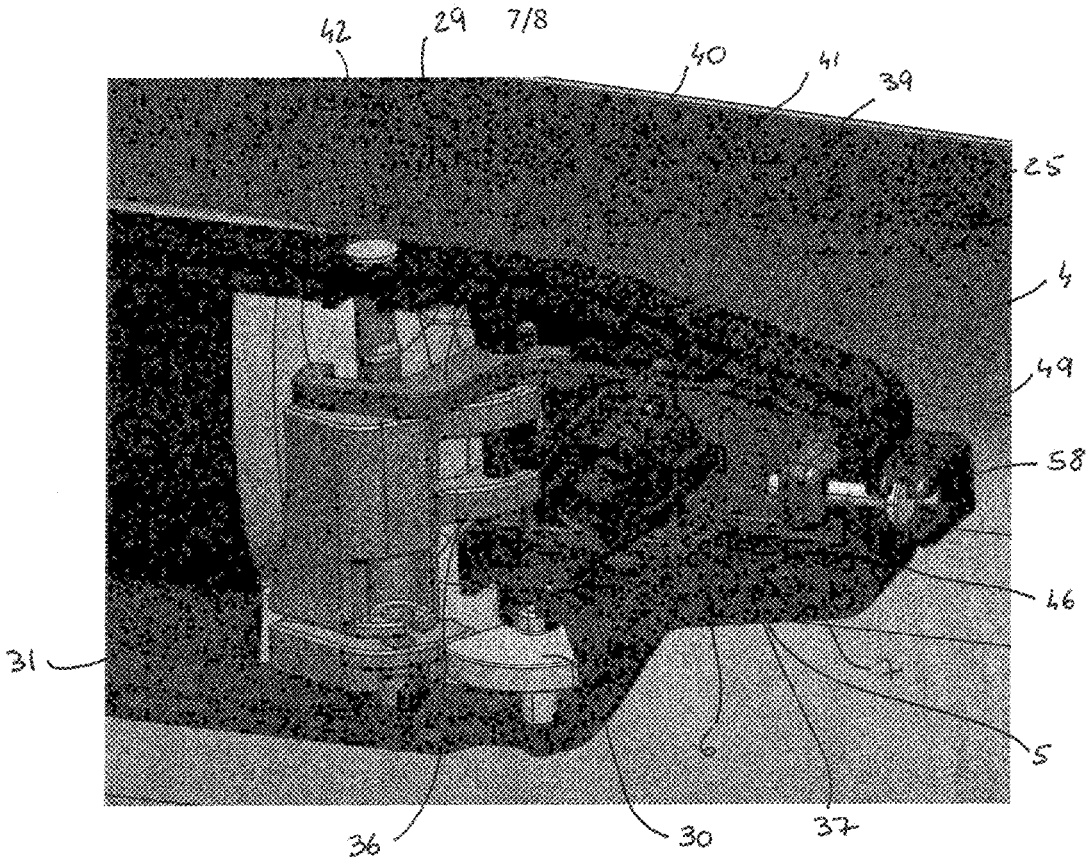
FIGS. 12 and 13 illustrate an internal view of a door panel assembly fitted on a door panel in an actuated position according to the present disclosure.
Figure 13:
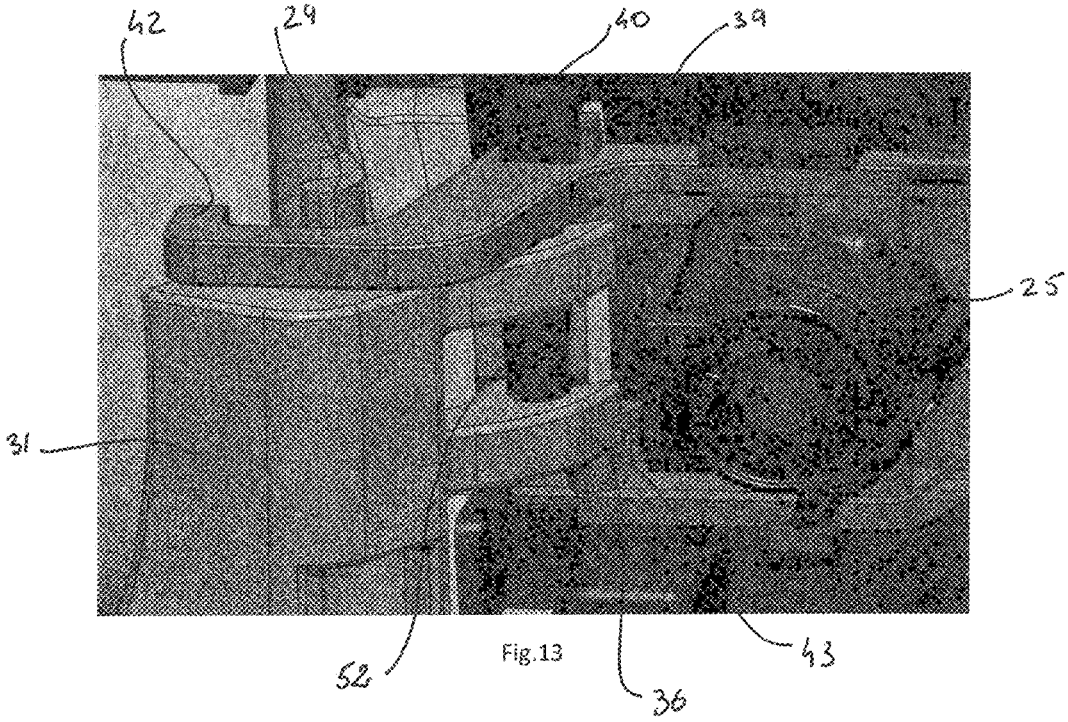

FIGS. 10 and 11 show the door handle assembly in a functional configuration and more precisely in its resting position, that is to say a position where the door is latched.

A user intended to open the vehicle door will pull the door grip 3. By doing so, the plunger 52 triggers the bellcrank 31 rotation which releases the latch mechanism.

The bellcrank 31 angular stroke is set (i) at one end corresponding to the door handle assembly resting position (see FIG. 11), by the handle grip 3 resting on the external face of the door panel 70; and (ii) at a second end corresponding to the door handle assembly actuated position (see FIGS. 12 and 13) by the bellcrank 31 coming in abutment with the rotation stops 43.

In the door handle assembly resting position, the hook 42 stays clear of the shoulder 29, thus providing that the handle grip 3 is fully biased against the door panel 70. FIG. 11 shows the gap the between the hook 42 and the shoulder 29.

In the door handle assembly actuated position that is to say when a user intends to open the vehicle door, the rotation stops 43 provided on the sliding member 37 provides that the bellcrank 31 does not over rotate to a position corresponding to the serviceable position where the bellcrank would disconnect from the plunger 52.

It is also understood that the vehicular door handle assembly is easily reversible. In other words, by driving the sliding member 37 to its rearward position, this being done by operating the screw 46, the handle grip 3 can be disconnected from the chassis 2. The bellcrank 31 moves to its serviceable position where the locking clip 36 are flush with the passageway 76 allowing the plunger 52 to disengage from the bellcrank 31. The door grip 3 can then be disengaged from the forward linkage. This proves to be advantageous, for example, when maintenance is required.

The description of the disclosure is merely exemplary in nature and, thus, variations that do not depart from the substance of the disclosure are intended to be within the scope of the disclosure. Such variations are not to be regarded as a departure from the spirit and scope of the disclosure.

What is claimed is:

1. A vehicular door handle assembly for opening a vehicle door, the vehicular door handle assembly comprising:

a door grip having a forward end and a rearward end, the door grip movable from a resting position where the vehicle door is latched to an actuated position where the vehicle door is unlatched;

a chassis assembly having a forward end and a rearward end, the rearward end configured to support: a bellcrank rotatably connected to the chassis and connected to the door grip, the bellcrank configured to pivot between a resting position and an actuated position when the door handle is actuated; and a retaining element moveable in a direction relative the forward end and the rearward end of the chassis and configured to retain the bellcrank in a serviceable position where the door grip is connected to the bellcrank and to release the bellcrank to a functional position such that the bellcrank rotates between the resting position and the actuated position.

2. The vehicular door handle assembly of claim 1, wherein the rotation of the bellcrank rotates with regards to the chassis within an angular stroke having:

a serviceable position wherein the retaining element maintains the bellcrank in a position where the door grip is connectable or disconnectable from the bell crank;

a resting position wherein the bellcrank maintains the door grip against the vehicle door, and an actuated position wherein the retaining element maintains the bell crank in a position wherein the bell crank actuates a latch mechanism and wherein the bellcrank remains engaged with the door grip.

3. The vehicular door handle assembly of claim 1 further comprising a driving feature operable from the chassis rearward end and configured to move the retaining element relative to the chassis assembly from the serviceable position to the resting position.

4. The vehicular door handle assembly of claim 1, wherein the retaining element comprises a sliding element having a sliding part and at least one arm configured to cooperate with the bellcrank.

5. The vehicular door handle assembly of claim 4, wherein the at least one arm includes a hook and the bellcrank includes a shoulder for seating the hook.

6. The vehicular door handle assembly of claim 4, wherein the sliding element includes at least one rotation stop such that the bellcrank abuts the at least one rotation stop in an actuated position wherein the bell crank actuates a latch mechanism, and wherein the bellcrank remains engaged with the door grip.

7. The vehicular door handle assembly according to claim 1, wherein the chassis includes a central opening and the bellcrank includes at least one locking clip substantially flush with the central opening in the serviceable position.

8. The vehicular door handle assembly according to claim 2, wherein the bellcrank angular stroke is defined by a hook provided at an end of at least one arm and by at least one rotation stop provided at a sliding member front end.

9. A method of installing a vehicle door assembly on a vehicular door panel having an external side and an internal side and at least a front passageway and a second passageway, the method comprising the steps of:

providing a chassis assembly having a forward end and a rearward end, said forward end having connecting features and said rearward end having a rotatable bellcrank maintained in a serviceable position by a retaining element moveable in a direction relative the forward end and the rearward end relative the chassis;

securing the chassis assembly on the internal side of the door panel;

providing a door grip movable to an actuated position to open a vehicle door, the door grip having a forward end and a rearward end, said forward end having a connection feature to connect with the connecting features of the chassis, said rearward end having a plunger;

mounting the door grip on the chassis forward end;

connecting the plunger on the bellcrank; and moving the retaining element to a position where the bellcrank can rotate between a resting position and an actuated position.

* * * * *